US005480528A

United States Patent [19]

Bischoping et al.

[11] Patent Number: 5,480,528

[45] Date of Patent: Jan. 2, 1996

[54] BRUSHLESS ELECTRODEPOSITION APPARATUS

[75] Inventors: Patricia Bischoping, Webster; Robert P. Altavela, Farmington; Lawrence Kotowicz, Rochester; Peter J. Schmitt, Ontario; William G. Herbert, Williamson, all of N.Y.; Ronald E. Jansen, Palm City, Fla.; John H. Lennon, Canandaigua, N.Y.; Henry G. Grey, Las Vegas, Nev.

[73] Assignee: Xerox Corporation, Stamford, Conn.

[21] Appl. No.: 201,952

[22] Filed: Feb. 25, 1994

[51] Int. Cl.[6] ..... C25D 17/00

[52] U.S. Cl. ..... 204/212; 204/219; 204/279

[58] Field of Search ..... 204/212, 279, 204/219

[56] References Cited

U.S. PATENT DOCUMENTS 2,867,574 1/1959 Berry ..... 204/212

3,799,861 7/1972 DiPietro ..... 204/279

3,844,906 10/1974 Bailey et al. ..... 204/9

3,876,510 4/1975 Wallin et al. ..... 204/9

*Primary Examiner*—John Niebling

*Assistant Examiner*—Brendan Mee

*Attorney, Agent, or Firm*—Zosan S. Soong

[57] ABSTRACT

An apparatus for depositing metal which provides a brushless electrical current continuity between a member, such as an electroforming mandrel or an electroplating rack, and a current source, comprising: (a) an electrode; (b) a member, spaced apart from the electrode, wherein the member defines a space that is partially or fully filled with a first conductive liquid in electrical contact with the member; (c) a second conductive liquid electrically isolated from the electrode; and (d) connecting means for electrically connecting the first conductive liquid and the second conductive liquid.

15 Claims, 2 Drawing Sheets

BRUSHLESS ELECTRODEPOSITION APPARATUS

CROSS REFERENCE TO RELATED COPENDING APPLICATION

Attention is directed to the following related application filed concurrently: Patricia Bischoping et al., "Brushless Electroforming Apparatus", Ser. No. 08/201951, the disclosure of which is totally incorporated by reference.

BACKGROUND OF THE INVENTION

This invention relates generally to a metal deposition cell and more particularly to a brushless electrodeposition apparatus employing conductive liquid contacts. The apparatus and processes described herein are illustrated primarily in the context of an electroforming process, but such apparatus and processes may be useful for other metal deposition processes including electroplating. The resulting electroformed articles are used for example as substrates in the fabrication of photoreceptors.

Electrodeposition apparatus, such as electroforming apparatus, often employ solid metal brushes and slip rings to provide current continuity between the current source and the mandrel. However, solid metal brushes are problematic: they eventually wear out which necessitates replacement; they may spark, and they may skip on the slip ring which would cause the voltage to fluctuate. This skipping and sparking also cause the slip ring to become pitted and bumpy (like what happens when a welding rod is touched against an electrically hot surface). The resulting pitting and bumpiness become a spot where a spark is generated each time a brush passes over it. Eventually the slip ring must be refinished (machined and often replated with silver). Another problem is that the brushes also pit which accelerates their wear and reduces their contact area which increases the contact voltage. If the contact voltage gets too high, the brush may burn causing instantaneous catastrophic failure. Indeed, the entire drive may be destroyed as well as the electrolyte. Note that solid nonslip systems also may exist where there is solid to solid contact. In addition, the mandrel is typically rotated during the electroforming process to nullify anode to cathode alignment perturbations and/or to obtain sufficient agitation to make it possible to deposit metal at an economical rate. However, conventional electroforming apparatus combine the mandrel rotation function with the current continuity function which increases the complexity of these systems, thereby causing a disproportionate amount of maintenance expense. Thus, there is a need for a brushless electroforming and electroplating apparatus which minimizes wear, sparking skipping, and voltage fluctuations. There is also a need for a brushless electroforming apparatus which separates the mandrel rotation function and the current continuity function to minimize maintenance expense.

Various electroforming apparatus and processes are known: Bailey et al., U.S. Pat. No. 3,844,906 and Wallin et at., U.S. Pat. No. 3,876,510.

SUMMARY OF THE INVENTION

It is an object of the present invention to provide a brushless apparatus employing conductive liquid contacts to enable current continuity between a member, such as a mandrel or a plating rack, and the current source in a metal deposition process.

It is another object in embodiments to provide a brushless electrodeposition apparatus which enables a constant and uniform electrical contact between the mandrel and the current source to substantially reduce or eliminate voltage fluctuations.

It is a further object to provide a brushless electrodeposition apparatus which separates the mandrel rotation function and the current continuity function.

It is an additional object to provide in embodiments a brushless electrodeposition apparatus employing conductive liquid contacts which do not wear out, spark, or skip.

These objects and others are accomplished in embodiments by providing an apparatus for depositing metal which provides a brushless electrical current continuity between a member and a current source, comprising: (a) an electrode; (b) a member, spaced apart from the electrode, wherein the member defines a space that is partially or fully filled with a first conductive liquid in electrical contact with the member; (c) a second conductive liquid electrically isolated from the electrode; and (d) connecting means for electrically connecting the first conductive liquid and the second conductive liquid. In embodiments, the member may be an electroforming mandrel or an electroplating rack adapted to hold at least one part for electroplating.

In embodiments of the instant invention, there is provided an apparatus for depositing metal on a mandrel which provides a brushless electrical current continuity between the mandrel and a current source, comprising: (a) an anode electrode; (b) a cathodic mandrel, spaced apart from the anode electrode, wherein the mandrel defines a space that is partially or fully filled with a first conductive liquid in electrical contact with the mandrel; (c) a second conductive liquid electrically isolated from the anode electrode; (d) connecting means for electrically connecting the first conductive liquid and the second conductive liquid; and (e) a rotation device, coupled to the mandrel, for rotating the mandrel during deposition of metal thereon.

BRIEF DESCRIPTION OF THE DRAWINGS

Other aspects of the present invention will become apparent as the description proceeds and upon reference the following preferred embodiments (the same reference numeral refers to the same or similar feature).

DETAILED DESCRIPTION

Figure 1:
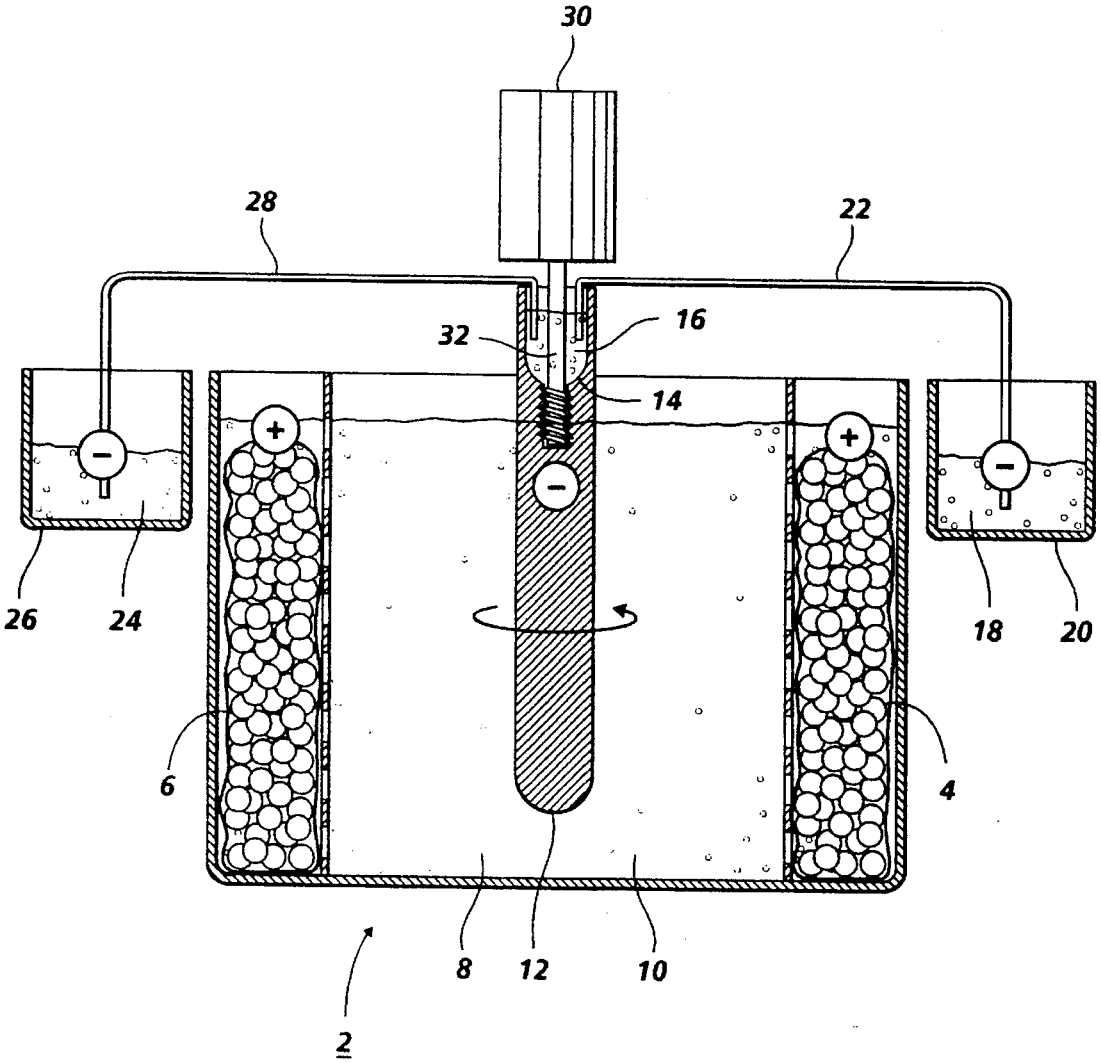
FIG. 1 represents a schematic, elevational, sectional view of a brushless electroforming apparatus employing a mandrel.

FIG. 1 discloses electroforming tank 2 comprised of first anode electrode 4, optional second anode electrode 6, channel 8, and electroforming solution 10. A member 12 in the form of a mandrel, disposed in the center of channel, defines therein space 14 that is at least partially filled with first conductive liquid 16 in electrical contact with mandrel 12. Second conductive liquid 18 is disposed in first trough 20. First trough 20 is positioned to one side of first anode electrode 4 and second conductive liquid 18 is electrically isolated therefrom by, for example, fabricating first trough 20 from a nonconducting material or a poorly conducting material. First connecting means 22, which may be in the form of a metal rod, has one end positioned in first conductive liquid 16, and the other end is positioned in second conductive liquid 18 to electrically connect first conductive liquid 16 and second conductive liquid 18. A brace (not shown), preferably fabricated from an electrically nonconductive material, optionally supports first connecting means 22. In embodiments, third conductive liquid 24, second trough 26, and second connecting means 28 are optional. Where employed as illustrated in the Figure, third conductive liquid 24 is disposed in second trough 26. Second trough 26 is positioned to one side of second anode electrode 6 and third conductive liquid 24 is electrically isolated therefrom by, for example, fabricating second trough 26 from a nonconducting material or a poorly conducting material. Second connecting means 28, which is in the form of a metal rod, has one end positioned in first conductive liquid 16, and the other end is positioned in third conductive liquid 24 to electrically connect first conductive liquid 16 and third conductive liquid 24. A brace (not shown), preferably fabricated from a nonconductive material such as a plastic, optionally supports second connecting means 28. Rotation means 30 is coupled to mandrel 12 to effect rotation thereof during the electroforming process. Shaft 32 of rotation means 30 may be coupled to the mandrel surface that defines the bottom of space 14 by any suitable means including for example external threads on the end of shaft 32 and internal threads in mandrel 12. The drive motor 30 preferably is electrically isolated from the rest of the system by, for example, making part of the shaft 32 between motor 30 and first conductive liquid 16 a nonconductive member. A conveyor device (not shown) transports the mandrel during the electroforming process.

In embodiments, the brushless electroforming apparatus as illustrated in FIG. 1 operates as follows. A direct current source (not shown) is coupled to the electroforming apparatus to apply current between the anode and the cathode, wherein the anode comprises first anode electrode 4 and second anode electrode 6, and the cathode comprises second conductive liquid 18 and third conductive liquid 24. Via first connecting means 22 and second connecting means 28, first conductive liquid 16 is rendered cathodic. Since first conductive liquid 16 is in electrical contact with the inner surface of mandrel 12, mandrel 12 is rendered cathodic as well. Mandrel 12 is rotated during the electroforming process, preferably prior to the deposit of any metal to the surface thereof. First connecting means 22 and second connecting means 28 may be in the form of conductive rods, each having an end disposed in first conductive liquid 16. A portion of the two connecting means may contact or rest against a surface of mandrel 12 which defines space 14, but the end portions of first connecting means 22 and second connecting means 28 are not fixedly coupled to the mandrel such as by a welded or bonded connection. Consequently, there is absent between mandrel 12 and connecting means (22, 28) any coupling which interferes with the rotation of the mandrel. A conveyor device transports mandrel 12 through channel 8 from entry to exit whereby metal is deposited on the mandrel surface during the electroforming process.

Unlike conventional solid metal brushes which eventually wear out due to a rubbing contact with a slip ring, the connecting means (22, 28) and the conductive liquids (16, 18, 24) seldom if ever need to be replaced since there is no rubbing contact between the connecting means and the conductive liquids, thereby minimizing maintenance costs. Moreover, as long as the ends of the connecting means (22, 28) remain in contact with the conductive liquids (16, 18, 24), the liquid nature of the conductive liquids generally ensures constant and uniform electrical contact with the ends of the connecting means, thereby minimizing or eliminating sparking, skipping, and voltage variations, problems which may occur with solid metal brushes. In addition, the instant brushless invention reduces maintenance costs as compared with a conventional apparatus employing brushes. A system using brushes requires periodic adjustment of the tension on the brushes. The present system does not need adjustment of the tension on the brushes since the invention involves a brushless system. Also, the brushes must be springloaded so that they will maintain contact with the slip ring and that this contact, under pressure, requires additional force to allow rotation, thereby requiring a larger motor. More moving parts also means more friction which adds to the load, again requiring larger motors. Maintenance costs are reduced by separating the mandrel rotation function and the current continuity function due to the reduction in the number of moving parts and the reduction in the load on the system.

Although the electrodes (4, 6) may comprise the cathode and the member 12 may comprise the anode of electroforming tank 2, the preferred configuration is where the electrodes (4, 6) comprise the anode and the member 12 comprises the cathode.

The mandrel may be of any effective design which defines therein a hollow portion that can be at least partially filled with the first conductive liquid. The mandrel may be entirely hollow in embodiments, but preferably the depth of the hollow portion ranges from about 1/10 to about 5/8 the mandrel length, and more preferably from about 1/8 to about 1/5 the mandrel length. The hollow portion of the mandrel is filled with an effective amount of the first conductive liquid to allow the ends of the one or more connecting means to establish electrical continuity between the mandrel and the current source. Preferably, the first conductive liquid fills from about 20 to about 90% the volume of the hollow portion of the mandrel. The mandrel is preferably open ended at one end as illustrated in the Figure to allow coupling of the rotation means to the mandrel and to allow positioning of one or more connecting means in the first conductive liquid. Mandrels similar to those illustrated in Herbert et al., U.S. Pat. No. 4,902,386, may be employed. The disclosure of U.S. Pat. No. 4,902,386 is hereby totally incorporated by reference. Preferred mandrels have the following dimensions: A length ranging from about 5 to about 50 cm; an outside cross sectional dimension ranging from about 10 mm to about 20 cm; a hollow portion having a length ranging from about 1 to about 8 cm; and a wall thickness for the hollow portion of the mandrel ranging from about 1 mm to about 3 cm. The mandrel may have any suitable cross sectional shape including cylindrical and oval.

Figure 2:
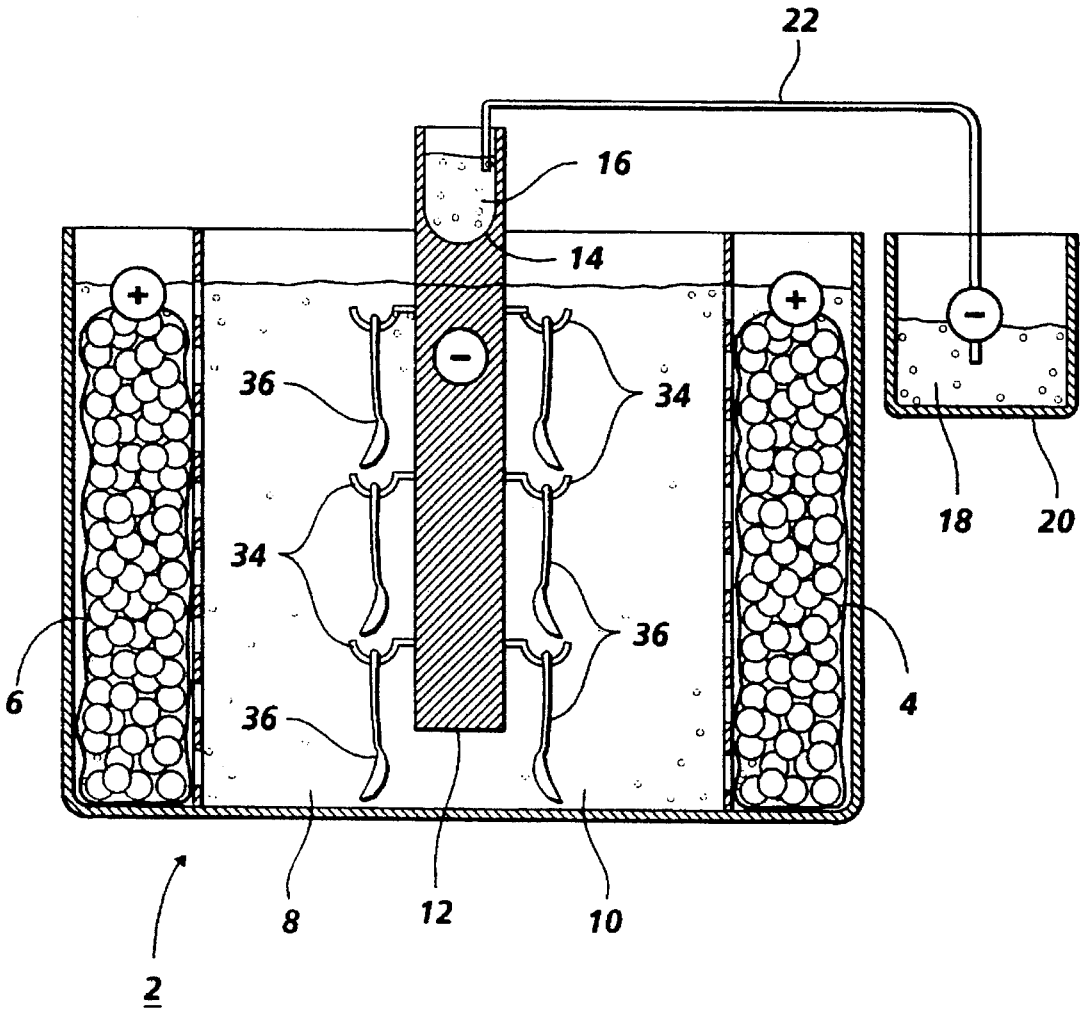
FIG. 2 represents a schematic, elevational, sectional view of a brushless electroplating apparatus employing a rack adapted to hold parts for electroplating.

FIG. 2 represents an illustrative brushless electroplating apparatus of the present invention. FIG. 2 discloses electroforming tank 2 comprised of first anode electrode 4, optional second anode electrode 6, channel 8, and electroplating solution 10. Member 12 defines therein space 14 that is at least partially filled with first conductive liquid 16 in electrical contact with member 12. Member 12 is comprised of metal hooks 34 coupled to member 12. Plating parts 36, which may be for example cutlery, automobile parts, jewelry, or any part that can be electroplated, hang from hooks 34. Second conductive liquid 18 is disposed in first trough 20. First trough 20 is positioned to one side of first anode electrode 4 and second conductive liquid 18 is electrically isolated therefrom by, for example, fabricating first trough 20 from a nonconducting material or a poorly conducting material described herein. First connecting means 22, which may be in the form of a metal rod, has one end positioned in first conductive liquid 16, and the other end is positioned in second conductive liquid 18 to electrically connect first conductive liquid 16 and second conductive liquid 18. A brace (not shown), preferably fabricated from an electrically nonconductive material, optionally supports first connecting means 22. A conveyor device (not shown) may be coupled to member 12 to transport member 12 into, out of, and/or through the bath. In FIG. 2, rotation of member 12 is optional. In FIG. 2, member 12 is preferably partially or totally covered with an electrically insulating material (not shown) to prevent metal deposition. Hooks 34 may be optionally covered with the electrically insulating material (not shown), except for the portion in contact with parts 36, to prevent metal deposition. The insulating material may be in a layer having a thickness of for example about 0.5 to about 3 mm. Suitable insulating materials include for instance plastisol (polyvinyl chloride) and MICROSHIELD™ (a lacquer).

In embodiments, the brushless electroplating apparatus as illustrated in FIG. 2 operates as follows (the apparatus of FIG. 2 and its principle of operation are similar to the system illustrated in FIG. 1 and thus the discussion herein pertaining to the apparatus of FIG. 1 applies completely to the apparatus of FIG. 2). A direct current source (not shown) is coupled to the electroplating apparatus to apply current between the anode and the cathode, wherein the anode comprises first anode electrode 4 and second anode electrode 6, and the cathode comprises second conductive liquid 18. Via first connecting means 22, first conductive liquid 16 is rendered cathodic. Since first conductive liquid 16 is in electrical contact with the inner surface of member 12, member 12 and the coupled hooks 34 are rendered cathodic as well. Since plating parts 36 are in physical and thus electrical contact with hooks 34, plating parts 36 are rendered cathodic and metal will deposit on the their surfaces.

The member 12 of FIG. 2 may be any suitable configuration. For example, member 12 may have a configuration similar to that of member 12 of FIG. 1 as described herein with the additional feature of a plurality of hooks 34 attached to the sides of member 12. Hooks 34 may be of any effective number such as from 1 to about 20, or more as needed; hooks 34 may have any effective shape to provide a surface for the plating parts 36 to rest or hang upon including for example a curved device, a rim, a protrusion, and the like which enables electrical contact between the plating part and member 12. In embodiments, there is at least one recessed portion in the side of member 12 to provide a spot for the plating parts. Member 12 in FIG. 2 may be considered in embodiments a type of rack or hanger upon which parts 36 are hung for electroplating. In another electroplating embodiment, the end of member 12 may be coupled through a conductive metal shaft to a metal tray or rack which holds the plating parts.

The various conductive liquids, i.e., the first conductive liquid, the second conductive liquid, and the third conductive liquid, may be the same or different from one another. Preferably, the conductive liquids are a metal which is a liquid below room temperature such as at about 20° C. (room temperature being about 25° C.), or which are a solid at room temperature and that liquifies when subjected to an elevated temperature ranging for example from above 25° C. to about 200° C. Thus, in embodiments, the first conductive liquid, the second conductive liquid, and/or the third conductive liquid may be subjected to elevated temperatures if the material is of the type that liquifies only at elevated temperatures. Preferred metals include mercury, gallium and low melt alloys such as those listed herein:

| MELTING POINT °C. | ALLOY Composition, wt % |
|---|---|
| 10.7 | Ga, 62.5; In, 21.5; Sn, 16.0 |
| 17 | Ga, 82.0; Zn, 6.0; Sn, 12.0 |
| 46.5 | Sn, 10.65; Bi, 40.63; Pb, 22.11; In, 18.1; Cd, 8.2 |
| 60.5 | In, 51.0; Bi, 32.5; Sn, 16.5 |
| 70 | Bi, 50.0; Pb, 25.0; Sn, 12.5; Cd, 12.5 |
| 70 | In, 67.0; Bi, 33.0 |
| 95 | Bi, 52.5; Pb, 32.0; Sn, 15.5 |
| 100 | Bi, 50.0; Pb, 30.0; Sn, 20.0 |
| 109 | Bi, 50.0; Pb, 28.0; Sn, 22.0 |
| 117 | In, 52.0; Sn, 48.0 |
| 123 | Bi, 46.1; Pb, 19.7; Sn, 34.2 |

Effective amounts of each conductive liquid is employed ranging for example from about 20 grams to about 5 kilograms for the first conductive liquid, and from about 10 to about 100 kilograms for the second and the third conductive liquids.

In embodiments, the conductive liquid may be silver oxide powder in air or carbon powder in water. However, carbon powder in water may not carry much current without heating up and melting which may be undesirable.

The second conductive liquid and the optional third conductive liquid are electrically isolated from the anode electrodes by any effective configuration. For example, the second and third conductive liquids are disposed in receptacles which may be comprised of an electrically nonconducting or poorly conducting material, or which may be spaced apart from the anode electrodes, or both. In embodiments, the receptacles may be separated by an effective gap from the anode electrodes, preferably ranging from about 1 cm to about 20 cm. The receptacles may be fabricated entirely from the nonconducting or poorly conducting material or may comprise only a lining of such material. Suitable nonconducting or poorly conducting materials include plastic and rubber such as for example polyvinyl chloride, polypropylene, KYNAR™, TEFLON™, and butyl rubber. The receptacles may be for example a trough which may extend along a portion, and preferably the entire length of the channel. Illustrative dimensions of the trough are a length ranging from about 20 cm to about 100 cm, a width ranging from about 1 cm to about 10 cm, and a depth ranging from about 1 cm to about 10 cm. In embodiments, the ends of the connecting means may travel through the trough to allow the connecting means to move with the mandrel as it travels through the channel. Alternatively, the receptacles may be in the form of a bucket, which is of an effective size and shape, and preferably has a cross sectional dimension ranging from about 3 cm to about 10 cm, and a depth ranging from about 1 cm to about 10 cm. In embodiments, the buckets are moved by suitable apparatus such as a conveyor belt or transport arm to allow the connecting means to move with the mandrel. The level of the conductive liquids in the receptacles may be any effective value, and preferably ranging from about ⅕ to about ½ the height of the receptacle.

The rotating means may be any suitable apparatus to rotate the mandrel such as a motor and coupling shaft or other mechanical device. The rotating means may couple to the mandrel by any effective means including for instance a shaft as illustrated in the FIG. 1 which couples to the mandrel interior, a gripping arm which holds the mandrel from the exterior, or an annular holding chuck which holds the mandrel from the interior or the exterior. The rotating means rotates the mandrel at an effective speed, and preferably ranging from about 1 to about 15 feet per second.

The mandrel may be moved through the channel as well as through the different cells of the metal deposition cycle by any suitable conveyor device. An electroforming cycle is comprised of different cells such as the preheat cell, the metal deposition tank which is described herein, the solution recovery cell, and the cooling cell. A typical electroforming cycle is illustrated in Bailey et al., U.S. Pat. No. 3,844,906, the disclosure of which is totally incorporated by reference. The conveyor device may comprise for example transporting arms or a conveyor belt, especially continuous, preferably employed with a cam to move the coated or uncoated mandrels up, down, and through the various cells of the metal deposition cycle, of which the electroforming cell or tank illustrated in the instant FIG. 1 typically constitutes only a single stage in the cycle. The conveyor device may be coupled to the rotation means or even directly to the mandrel in embodiments.

The connecting means may be any suitable apparatus to provide electrical continuity between the member and the second and the third conductive liquids. For example, the connecting means may be a conductive, solid or hollow metal rod fabricated preferably from a suitable metal such as stainless steel, copper, zinc, iron, aluminum, nickel, and the like. In embodiments, the connecting means may be a plastic pipe filled with a conductive liquid such as those described herein. In embodiments, the connecting means may comprise multiple wires such as two, three, four, five or more. Sections of the connecting means may be bent into suitable configurations as illustrated in the Figure to facilitate positioning of the connecting means in the various conductive liquids. The connecting means has an effective thickness for transmitting current, and preferably has an outer cross sectional dimension ranging from about 5 mm to about 5 cm. In embodiments where the member such as the mandrel moves through the channel of the electrodeposition tank, the connecting means moves in conjunction with the member via the employment of a trough or a moving bucket as described herein.

The anode may be fabricated from any suitable material and is of any effective design. In embodiments, the anode may be wholly or partially consumed in the metal deposition process by being fabricated from a material which is used to replenish the electrolytic bath to replace the metal being electrodeposited out of solution. However, it is preferred that the anode is fabricated from a material which is not consumed by the process. In such situations, the anode may be for example a basket containing a bath replenishment metal and is fabricated from a metal such as titanium which is typically not consumed in the metal deposition process. The basket may incorporate openings to permit flow of metal ions from the basket into the bath. The anode optionally contains a fabric anode bag made from a suitable material such as nap polyolefin to hold the bath replenishment metal. The fabric anode bag is preferably open at the top to allow addition of bath replenishment metal. The anode may have any effective shape and is preferably straight sided.

The channel defined by the anodes may be of any appropriate width, length, and height for a metal deposition process. The channel has the following illustrative dimensions: a width ranging from about 5 to about 50 cm; a length ranging from about 20 to about 150 cm; and a height ranging from about 3 to about 20 cm.

The voltage and the current density supplied by the DC source may be any effective value, and preferably range from about 10 to about 25 volts and from about 20 to about 600 amperes per square foot of mandrel surface.

The deposition metal may be any metal conventionally used in electroforming and electroplating including nickel, sulfur depolarized nickel, and carbonyl nickel.

A preferred electroforming or plating solution is as follows:

Total Deposition Metal (such as nickel): 8.0 to 17.0 oz/gal (the recited concentration for the Total Deposition Metal refers to the metal in solution);

Deposition Metal (M) Halide (X) as $MX_2 \cdot 6H_2O$: 0.5 to 3.0 oz/gal; and

Buffering Agent (such as $H_3BO_3$): 4.5 to 6.0 oz/gal.

Optionally, there is continuously charged to said solution about 1.0 to $2.0\times 10^{-4}$ moles of a stress reducing agent per mole of deposition metal electrolytically deposited from the solution. The metal halide may be any suitable compound typically used in electroforming solutions including nickel chloride, nickel bromide, and nickel fluoride.

For continuous, stable operation with high throughput and high yield of acceptable electroformed articles, a nickel sulfamate solution is preferred and is maintained at an equilibrium composition within the electroforming zone. The preferred nickel sulfamate solution comprises:

Total Nickel (the recited Total Nickel concentration refers to the nickel ions in solution): 11.0 to 12 oz/gal;

Chloride as $NiCl_2\sqrt{6H_2O}$: 1.6 to 1.7 oz/gal;

$H_3BO_3$: 5.0 to 5.4 oz/gal;

pH: 3.8 to 4.1; and

Surface Tension: 33 to 37 dynes/cm$^2$ as determined by a surface tensionometer.

Additionally, from about 1.3 to $1.6\times 10^{-4}$ moles of a stress reducing agent per mole of nickel electrolytically deposited from the solution is continuously charged to the electrodeposition solution. Suitable stress reduction agents are sodium sulfobenzimide (saccharin), 2-methylbenzenesulfonamide, benzene sulfomate, naphthalene trisulfomate, and mixtures thereof.

The temperature of the electroforming or plating solution may be between about 100° and 160° F. and preferably is between about 135° and 145° F.

The metal deposited on the mandrel or on the plating parts may be of an effective thickness, and preferably ranges from about 1 mm to about 3 cm in thickness. The electroformed article may be of any suitable shape including a cylinder and an endless belt. The electroformed article preferably is ductile, electrically conductive, and seamless, with a relatively high tensile strength of from about 90,000 to about 190,000 psi, and a ductility of between about 3 to 12%. In order to be suitable for use as a flexible substrate for the image retention surface in an electrostatographic apparatus, it is important that the formed article exhibits a high degree of thickness uniformity and a controlled degree of surface roughness. Generally, the surface roughness exhibited by the formed article ranges from about 1 to 80 microinches, RMS, and preferably, from about 10 to 35 microinches, RMS.

Further details of the electrodeposition solution, apparatus, and methods are illustrated in Bailey et al., U.S. Pat. No. 3,844,906 and Wallin et al., U.S. Pat. No. 3,876,510, the disclosures of which are totally incorporated by reference.

Other modifications of the present invention may occur to those skilled in the art based upon a reading of the present disclosure and these modifications are intended to be included within the scope of the present invention.

We claim:

1. An apparatus for depositing metal on a mandrel which provides a brushless electrical current continuity between the mandrel and a current source, comprising:

(a) an anode electrode;

(b) a cathodic mandrel, spaced apart from the anode electrode, wherein the mandrel defines a space that is partially or fully filled with a first conductive liquid in electrical contact with the mandrel;

(c) a second conductive liquid electrically isolated from the anode electrode;

(d) connecting means for electrically connecting the first conductive liquid and the second conductive liquid; and (e) a rotation device, coupled to the mandrel, for rotating the mandrel during deposition of metal thereon.

2. The apparatus of claim 1, wherein there is absent between the mandrel and the connecting means any coupling which interferes with the rotation of the mandrel.

3. The apparatus of claim 1, wherein the first conductive liquid and the second conductive liquid are comprised of the same or different material.

4. The apparatus of claim 1, wherein the first conductive liquid and the second conductive liquid are a metal.

5. The apparatus of claim 1, wherein the first conductive liquid and the second conductive liquid are mercury or a low melt alloy.

6. The apparatus of claim 1, wherein the first conductive liquid, the second conductive liquid, or both are a liquid at room temperature or are a solid at room temperature that liquifies when subjected to an elevated temperature ranging from above 25° to about 200° C.

7. The apparatus of claim 1, further comprising a second anode electrode spaced apart from the anode electrode which defines therebetween a channel, wherein the mandrel is disposed in the channel and the second conductive liquid is electrically isolated from the second anode electrode.

8. The apparatus of claim 7, further comprising a third conductive liquid electrically isolated from the anode electrode and the second anode electrode; and second connecting means for electrically connecting the first conductive liquid and the third conductive liquid, wherein there is absent between the mandrel and the second connecting means any coupling which interferes with the rotation of the mandrel.

9. The apparatus of claim 8, wherein the third conductive liquid is mercury or a low melt alloy.

10. The apparatus of claim 1, wherein the second conductive liquid is disposed in a receptacle which is comprised of an electrically nonconductive or poorly conductive material, which is spaced apart from the anode electrode, or both.

11. The apparatus of claim 10, wherein the receptacle is a trough.

12. The apparatus of claim 10, further comprising receptacle transport device for moving the receptacle.

13. The apparatus of claim 1, wherein the connecting means comprises a hollow or solid conductive rod, wherein one end of the rod is disposed in the first conductive liquid and the other end of the rod is disposed in the second conductive liquid.

14. The apparatus of claim 1, further comprising a conveyor device for transporting the mandrel.

15. The apparatus of claim 1, wherein the first conductive liquid fills about 20 to about 90% by volume of the space defined by the mandrel.

* * * * *